US012084860B2

(12) United States Patent
Roach et al.

(10) Patent No.: US 12,084,860 B2
(45) **Date of Patent: *Sep. 10, 2024**

(54) STRUCTURAL JOISTS AND METHODS TO MANUFACTURE THE SAME

(71) Applicant: Trilogy Structural, LLC, Indianapolis, IN (US)

(72) Inventors: Michael Roach, Indianapolis, IN (US); Andrew Kays, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/701,518

(22) Filed: Mar. 22, 2022

(65) Prior Publication Data

US 2022/0282485 A1 Sep. 8, 2022

Related U.S. Application Data

(63) Continuation of application No. 16/303,533, filed as application No. PCT/US2017/033053 on May 17, 2017, now Pat. No. 11,280,091.

(60) Provisional application No. 62/339,583, filed on May 20, 2016.

(51) Int. Cl.

| | |
|---|---|
| ***E04C 3/07*** | (2006.01) |
| ***E04B 5/10*** | (2006.01) |
| ***E04C 3/04*** | (2006.01) |

(52) U.S. Cl.

CPC ..... *E04C 3/07* (2013.01); *E04B 5/10* (2013.01); *E04C 2003/0408* (2013.01); *E04C 2003/0439* (2013.01); *E04C 2003/0456* (2013.01)

(58) Field of Classification Search

CPC ..... E04C 3/07; E04C 2003/0408; E04C 2003/0439; E04C 2003/043; E04C 2003/0443; E04C 2003/0456; E04B 5/10

See application file for complete search history.

(56) References Cited

U.S. PATENT DOCUMENTS

| | | | | |
|---|---|---|---|---|
| 1,407,242 A * | 2/1922 | Hamilton | B64C 1/065 296/204 |
| 2,605,867 A * | 8/1952 | Goodwin | E04C 3/07 52/840 |
| 3,342,007 A * | 9/1967 | Merson | E04C 3/07 52/364 |
| 3,517,474 A * | 6/1970 | Laternier | E04C 3/07 52/842 |
| 3,703,085 A * | 11/1972 | Wogerbauer | E04C 3/07 405/276 |

(Continued)

FOREIGN PATENT DOCUMENTS

| | | |
|---|---|---|
| CN | 103810308 A | 5/2014 |
| EP | 0267843 A1 | 5/1988 |

OTHER PUBLICATIONS

International Searching Authority, International Search Report, PCT/US2017/033053, Dated Sep. 17, 2017.

(Continued)

*Primary Examiner* — Christine T Cajilig

(74) *Attorney, Agent, or Firm* — Reichel Stohry Dean LLP; Mark C. Reichel; Natalie J. Dean

(57) ABSTRACT

A joist is disclosed. The joist includes a first leg portion, a second leg portion, and a central portion, wherein each of the first leg portion and the second leg portion define a first side, a second side, and a distal side, and one or more stiffeners defined within each of the first side, the second side, and the distal side of the first leg portion and the second leg portion.

20 Claims, 17 Drawing Sheets

(56) References Cited

U.S. PATENT DOCUMENTS

| | | | | | |
|---|---|---|---|---|---|
| 5,163,225 | A * | 11/1992 | Goleby | E04C 3/07 | 29/897 |
| 5,373,679 | A | 12/1994 | Goleby | | |
| 5,417,028 | A * | 5/1995 | Meyer | E04C 3/07 | 52/693 |
| 5,499,480 | A | 3/1996 | Bass | | |
| 5,875,605 | A * | 3/1999 | Rudd | E04C 3/292 | 52/847 |
| 6,131,362 | A | 10/2000 | Buecker | | |
| 2007/0056240 | A1* | 3/2007 | Nanayakkara | E04C 3/09 | 52/634 |
| 2008/0250738 | A1* | 10/2008 | Howchin | E04B 2/789 | 52/235 |
| 2012/0291386 | A1* | 11/2012 | Miniscloux | B21D 13/10 | 52/340 |

OTHER PUBLICATIONS

International Searching Authority, Written Opinion of the International Searching Authority, PCT/US2017/033053, Dated Sep. 17, 2017.

* cited by examiner

STRUCTURAL JOISTS AND METHODS TO MANUFACTURE THE SAME

PRIORITY AND CROSS-REFERENCE TO RELATED APPLICATIONS

The present application is related to, claims the priority benefit of, and is a U.S. continuation patent application of, U.S. patent application Ser. No. 16/303,533, filed Nov. 20, 2018 and issued as U.S. Pat. No. 11,280,091 on Mar. 22, 2022, which is related to, and is a U.S. National Phase patent application of, International Patent Application Serial No. PCT/2017/033053, filed May 17, 2017, which is related to, and claims the priority benefit of, U.S. Provisional Patent Application Ser. No. 62/339,583, filed May 20, 2016. The contents of each of the aforementioned patent applications are hereby incorporated by reference in their entirety into this disclosure.

BACKGROUND

Steel joist technology has been relatively flat over the past several decades, with traditional I-joists and open web steel joists dominating the market. Nontraditional joists, such as those disclosed within U.S. Pat. No. 5,373,679, attempted to provide for various other joist configurations. However, the joists disclosed therein did not make use of intermediate stiffeners and were still limited by local buckling. As such, said joist configurations did not enjoy any significant commercial success.

BRIEF SUMMARY

In an exemplary embodiment of a joist of the present disclosure, the joist comprises a first leg portion (also referred to herein as a top flange), a second leg portion (also referred to herein as a bottom flange), and a central portion (also referred to herein as a web), wherein each of the first leg portion and the second leg portion define a first side, a second side, and a distal side; a first lap portion and a second lap portion located at the central portion; and one or more stiffener defined within one or more of the first side, the second side, and/or the distal side, such as, for example, at each of the first side, the second side, and the distal side of the first leg portion and/or the second leg portion.

In an exemplary embodiment of a joist of the present disclosure, the joist defines at least one stiffener of the one or more stiffeners within each of the first side, the second side, and the distal side of each of the first leg portion and the second leg portion.

In an exemplary embodiment of a joist of the present disclosure, the joist defines at least one stiffener of the one or more stiffeners within each of the first side and the second side of the first leg portion.

In an exemplary embodiment of a joist of the present disclosure, the joist defines at least one stiffener of the one or more stiffeners within the distal side and at least one of the first side and the second side of the first leg portion.

In an exemplary embodiment of a joist of the present disclosure, the joist defines at least one stiffener of the one or more stiffeners within each of the first side and the second side of the second leg portion.

In an exemplary embodiment of a joist of the present disclosure, the joist defines at least one stiffener of the one or more stiffeners within the distal side and at least one of the first side and the second side of the second leg portion.

In an exemplary embodiment of a joist of the present disclosure, the joist defines at least one stiffener of the one or more stiffeners within each of the first side and the second side of the second leg portion.

In an exemplary embodiment of a joist of the present disclosure, the joist defines at least one stiffener of the one or more stiffeners within the distal side and at least one of the first side and the second side of the second leg portion.

In an exemplary embodiment of a joist of the present disclosure, wherein the joist defines at least one stiffener of the one or more stiffeners within each of the first side and the second side of the second leg portion.

In an exemplary embodiment of a joist of the present disclosure, the joist defines at least one stiffener of the one or more stiffeners within the distal side and at least one of the first side and the second side of the second leg portion.

In an exemplary embodiment of a joist of the present disclosure, the joist defines at least one additional stiffener defined within at least one of the first side, the second side, and the distal side of at least one of the first leg portion and/or the second leg portion.

In an exemplary embodiment of a joist of the present disclosure, the central portion positioned in between the first leg portion and the second leg portion.

In an exemplary embodiment of a joist of the present disclosure, the first leg portion first side, the first leg portion second side, the second leg portion first side, and the second leg portion second side each have a first stiffener having a first depth defined therein.

In an exemplary embodiment of a joist of the present disclosure, the first leg portion distal side and the second leg portion distal side each have a second stiffener having a second depth defined therein, wherein the first depth is different than the second depth.

In an exemplary embodiment of a joist of the present disclosure, the joist defines the at least one stiffener within one or more of the sides and at least one additional stiffener defined within at least one of the first side, the second side, and the distal side of at least one of the first leg portion and/or the second leg portion.

In an exemplary embodiment of a joist of the present disclosure, the joist comprises a first leg portion having a first leg portion first side, a first leg portion second side, and a first leg portion distal side; a second leg portion having a second leg portion first side, a second leg portion second side, and a second leg portion distal side; a central portion positioned in between the first leg portion and the second leg portion; wherein at least one of the first leg portion first side, the first leg portion second side, the first leg portion distal side, the second leg portion first side, the second leg portion second side, and/or the second leg portion distal side has at least one stiffener defined therein.

In an exemplary embodiment of a joist of the present disclosure, a first leg portion having a first leg portion first side, a first leg portion second side, and a first leg portion distal side; a second leg portion having a second leg portion first side, a second leg portion second side, and a second leg portion distal side; a central portion positioned in between the first leg portion and the second leg portion; wherein the first leg portion first side, the first leg portion second side, the second leg portion first side, and the second leg portion second side each have a first stiffener having a first depth defined therein.

In an exemplary embodiment of a joist of the present disclosure, the first leg portion distal side and the second leg portion distal side each have a second stiffener having a second depth defined therein, wherein the first depth is different than the second depth.

In an exemplary embodiment of a joist of the present disclosure, the first leg portion distal side and the second leg portion distal side each have a third stiffener having a third depth defined therein, wherein the third depth is different than the first depth and the second depth.

In an exemplary embodiment of a joist of the present disclosure, the first leg portion distal side and the second leg portion distal side each have two second stiffeners each having a second depth defined therein, wherein the first depth is different than the second depth.

In an exemplary embodiment of a joist of the present disclosure, the first leg portion distal side and the second leg portion distal side each have two third stiffeners each having a third depth defined therein, wherein the third depth is different than the first depth and the second depth.

In an exemplary embodiment of a joist of the present disclosure, a first leg portion having a first leg portion first side, a first leg portion second side, and a first leg portion distal side; a second leg portion having a second leg portion first side, a second leg portion second side, and a second leg portion distal side; a central portion positioned in between the first leg portion and the second leg portion; wherein the first leg portion first side, the first leg portion second side, the second leg portion first side, and the second leg portion second side each have a first stiffener defined therein; and wherein the first leg portion distal side and the second leg portion distal side each have a plurality of additional stiffeners defined therein.

The present disclosure includes disclosure of a cold-formed joist. In an exemplary embodiment of a joist of the present disclosure, the joist comprises a single elongated metal plate. In an exemplary embodiment of a joist of the present disclosure, the joist comprises two or more elongated metal plates. In an exemplary embodiment of a joist of the present disclosure, the joist comprises a first joist component and a second joist component, wherein each of the first joist component and the second joist component define a first side, a second side, and a distal side; a central joist component coupled to the first joist component and the second joist component; and at least one stiffener defined within each of the first side, the second side, and the distal side of the first joist component and the second joist component.

The present disclosure includes disclosure of a joist, comprising a first leg portion, a second leg portion, and a central portion, wherein each of the first leg portion and the second leg portion define a first side, a second side, and a distal side; a first lap portion and a second lap portion located at the central portion; and at least one stiffener defined within at least one of the first side, the second side, and the distal side of the first leg portion and the second leg portion.

The present disclosure includes disclosure of a joist, as shown and/or described. The present disclosure also includes disclosure of a joist, generated by bending an elongated metal plate so to generate the joist.

The present disclosure includes disclosure of a computing system, comprising a storage medium, and a processor operably coupled to the storage medium, wherein the processor is configured to receive various joist variables and values associated with those variable and generate a plurality of joist configuration outputs.

The present disclosure includes disclosure of a software program, configured to be stored on a storage medium of a computer and operable using a processor operably coupled to the storage medium, whereby the software program is configured to receive various joist variables and/or variable ranges and generate a plurality of joist configuration outputs.

BRIEF DESCRIPTION OF THE DRAWINGS

The disclosed embodiments and other features, advantages, and disclosures contained herein, and the matter of attaining them, will become apparent and the present disclosure will be better understood by reference to the following description of various exemplary embodiments of the present disclosure taken in conjunction with the accompanying drawings, wherein.

Figure 1:
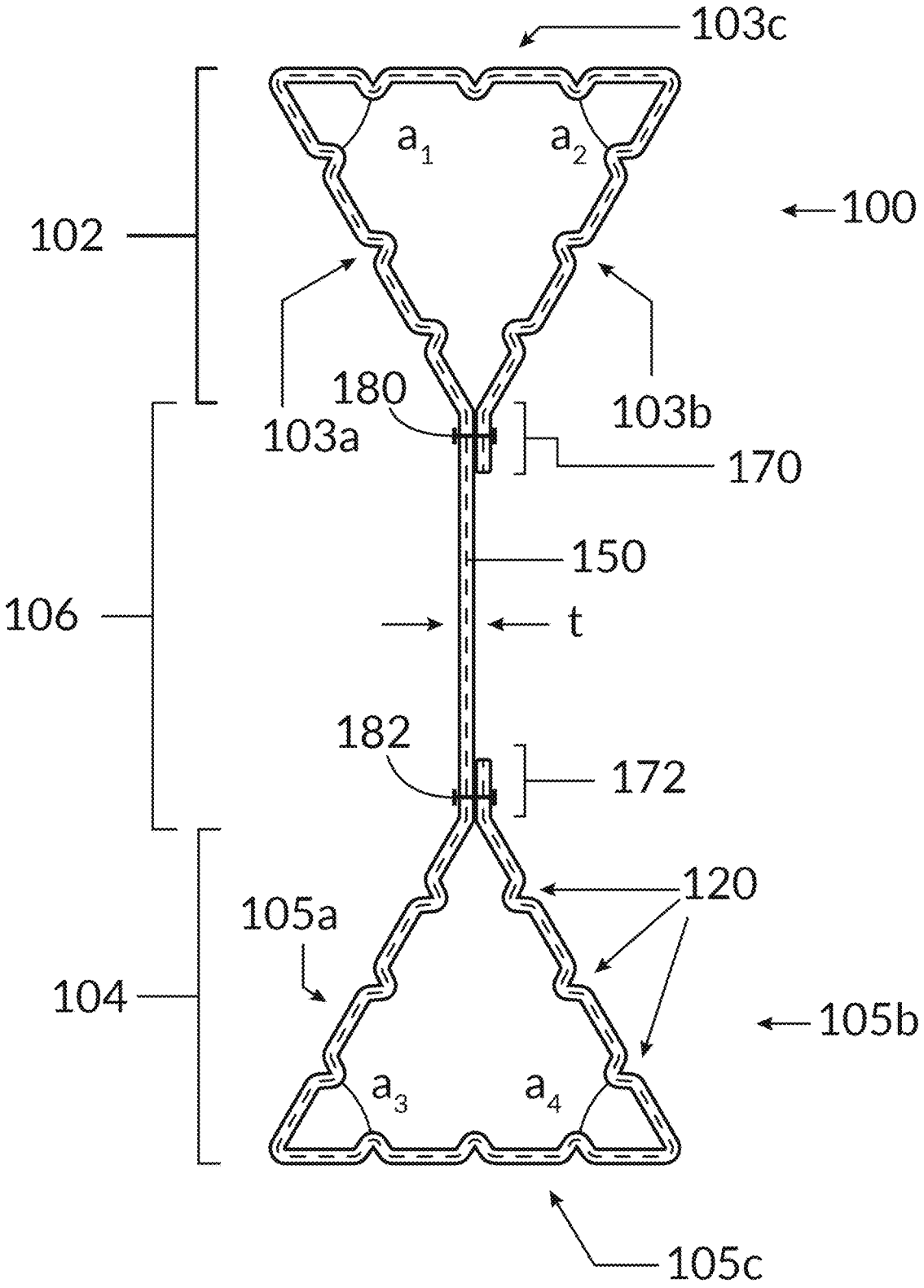
FIGS. 1 and 2 show cross-sections of joists, according to exemplary embodiments of the present disclosure.

An overview of the features, functions and/or configurations of the components depicted in the various figures will now be presented. It should be appreciated that not all of the features of the components of the figures are necessarily described. Some of these non-discussed features, such as various couplers, etc., as well as discussed features are inherent from the figures themselves. Other non-discussed features may be inherent in component geometry and/or configuration.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended. It is noted that the term "exemplary," as used herein with respect to various embodiments, is intended to mean "example" and is not intended to infer such an embodiment as being the "ideal" or "primary" embodiment.

The present disclosure includes disclosure of cold formed steel joists and methods to generate the same. As will be provided in further detail herein, the present disclosure includes disclosure of methods that when performed will generate steel joists that minimize weight and deflections while maximizing flexural strength and shear capacity. The present disclosure is therefore an improvement over traditional steel joists for several reasons.

FIG. 1 shows a cross-section of an exemplary joist 100 of the present disclosure. As shown therein, exemplary joists 100 of the present disclosure comprise a first leg portion 102 (also referred to herein as a top flange) and a second leg portion 104 (also referred to herein as a bottom flange), whereby first leg portion 102 and second leg portion 104 are at relative ends of joist 100 and are connected to one another by way of a central portion 106 (also referred to herein as a web). First leg portion 102 and second leg portion 104 can comprise any number of shapes, such as triangular shapes as shown in FIG. 1, but can also comprise other shapes as may be desired, such as square shapes, hexagonal shapes, rectangular shapes, and the like.

Figure 19:
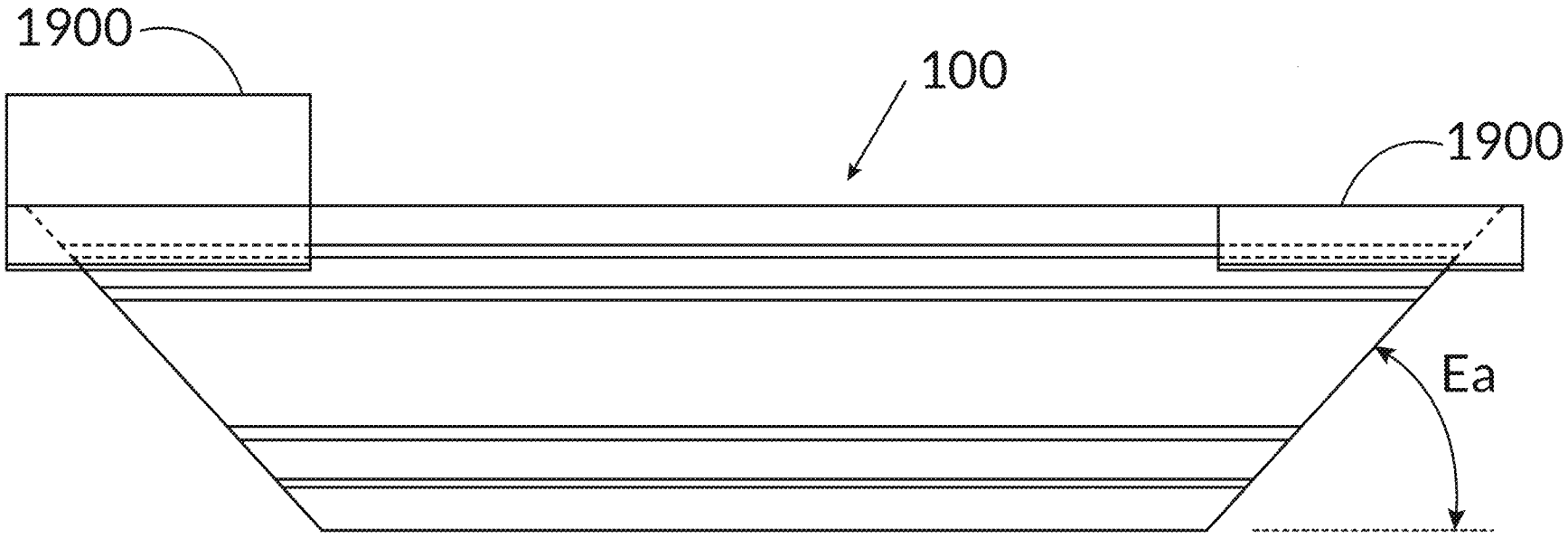
FIG. 19 shows a side view of a joist, according to an exemplary embodiment of the present disclosure.

Joists 100 of the present disclosure also comprise at least one, and preferably a plurality, of stiffeners 120 at one or both of first leg portion 102 and second leg portion 104, such as shown in FIG. 1. Stiffeners 120, as provided in greater detail herein, comprise protrusions into or indentations out of one or both of first leg portion 102 and second leg portion 104, and can vary in number, size, and shape depending on joist 100 configuration. For example, and as shown in FIG. 1, an exemplary joist 100 of the present disclosure comprises three stiffeners 120 along a first side 103*a* of first leg portion 102, three stiffeners 120 along a second side 103*b* of first leg portion 102, three stiffeners 120 along a distal side 103*c* of first leg portion 102, three stiffeners 120 along a first side 105*a* of second leg portion 104, three stiffeners 120 along a second side 105*b* of second leg portion 104, and three stiffeners 120 along a distal side 105*c* of second leg portion 104. Distal sides 103*c* and 105*c* are configured to be perpendicular or relatively perpendicular to central portion 106 of joist 100 in various joist 100 embodiments. Span (i.e., the dimension into and out of the page, or along the general length of joist 100 as shown in FIG. 19) of joist 100 is application-dependent based on the desired span of joist 100. Angles $a_1$ and $a_2$ (within first leg portion 102) and $a_3$, and $a_4$ (within second leg portion 104) as shown in FIG. 1, can also vary as desired, and may include, for example, 60° angles as shown in FIG. 1.

Joists 100 of the present disclosure are generally formed by way of bending an elongated metal plate 150, as shown in FIG. 1, which can have a desired thickness t, also shown in FIG. 1. A first lap portion 170 may exist, whereby a portion of metal plate 150 overlaps with itself adjacent to first leg portion 102, and a second lap portion 172 may exist, whereby a portion of metal plate 150 overlaps with itself adjacent to second leg portion 104, such as shown in FIG. 1. First lap portion 170 and/or second lap portion 172 can be secured together using welds 178 (as shown in FIG. 2, which may be spot welds, elongated welds, or a combination of the same), rivets 180 (as shown in FIG. 1), fasteners 182 (such as bolts, nuts, screws, nails, and/or other fasteners, as shown in FIG. 1), as may be desired, so to secure one portion of elongated metal plate 150 (such as along central portion 106) with another portion of elongated metal plate 150 (also such as along central portion 106), as shown in FIG. 1.

Figure 2:
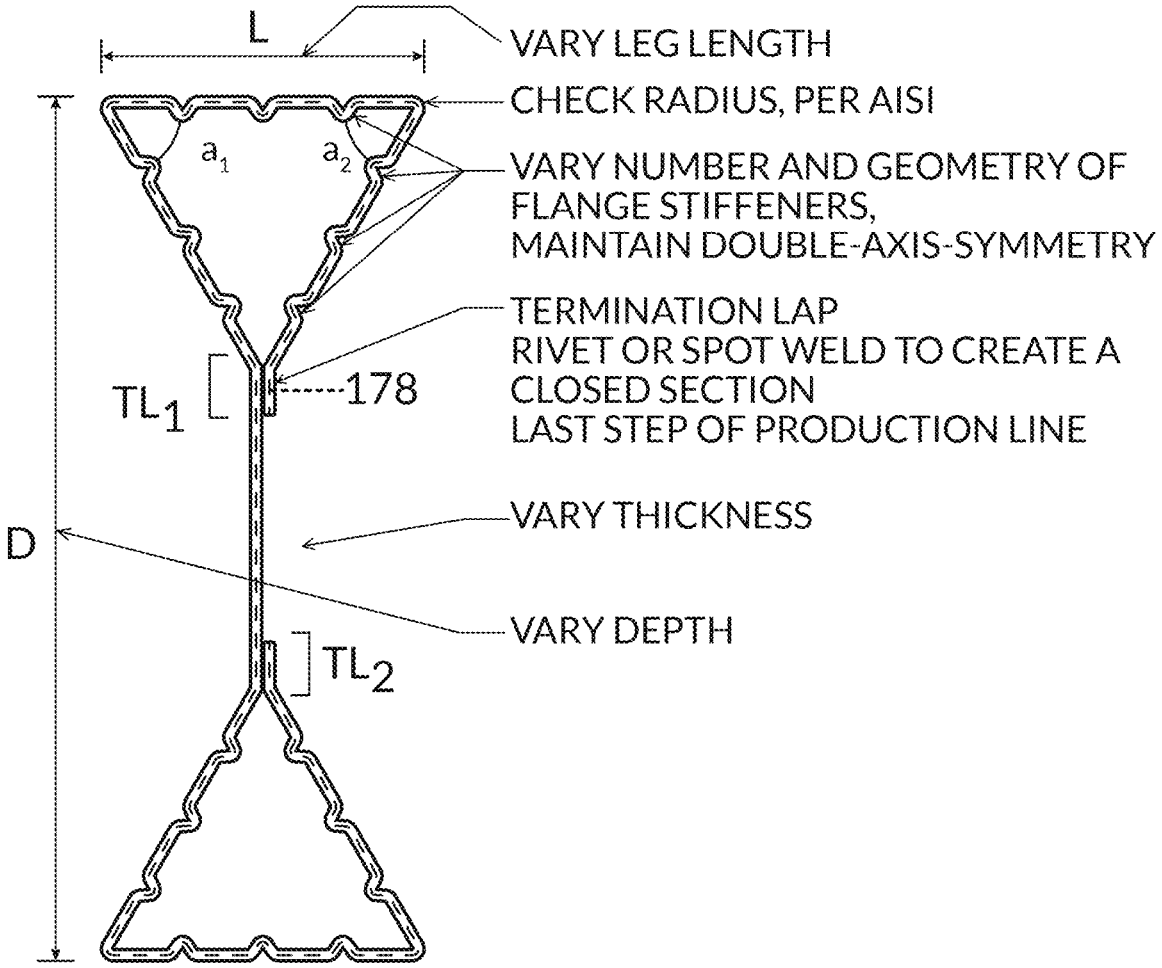

Additional details regarding the aforementioned elements are also referenced in FIG. 2. FIG. 2 also shows that an overall depth D and/or an overall leg length L can be varied as desired.

Accordingly, various joists 100, and various methods of generating the same, can vary in dimension, shape, and/or configuration, by way of varying one or more of the following items:

- Joist 100 depth ("D" as referenced in FIG. 2)
- Joist 100 thickness ("t" as referenced in FIG. 1)
- Angles ("$a_1$," "$a_2$," "$a_3$," and/or "$a_4$" as referenced in FIG. 1)
- Number of stiffeners 120
- Location of stiffeners 120
- Length of first lap portion 170 ("$TL_1$" as referenced in FIG. 2) and/or second lap portion 172 ("$TL_2$" as referenced in FIG. 2)
- Length ("L" as referenced in FIG. 2) of side 103*c* of first leg portion 102 and/or side 105*c* of second leg portion 104
- Fillet radius of triangle vertices, namely where side 103*a* transitions to side 103*c*, where side 103*b* transitions to side 103*c*, where side 105*a* transitions to side 105*c*, and/or where side 105*b* transitions to side 105*c*
- Geometry of stiffeners 120 (such as stiffener 120 depth, stiffener 120 width, and fillet arc radii, as noted above One or more of said parameters referenced above can be used, for example, as inputs into software program 300 configured to generate models of joists 100 prior to production, for example.

Using an exemplary embodiment of said software program 300, various charts of data points were generated in attempt to identify an optimal joist 100 configuration for a particular purpose, without stiffeners 120. In a first test, the following parameters were used:

- Lengths (L) of side 103*c* of first leg portion 102 and side 105*c* of second leg portion 104, ranging from 1" to 5" and using 0.25" increments
- Thicknesses (t) of elongated metal plate 150, ranging from 0.02" to 0.2" and using 0.02" increments
- Angles $a_1$, $a_2$, $a_3$, and $a_4$, ranging from 15° to 60° and using 5° increments
- A depth (D) of 10"

Lengths of first lap portion 170 and second lap portion 172 ($TL_1$ and $TL_2$) of 1"

A triangle vertex radius of ⅛"

No stiffeners 120

Figure 3:
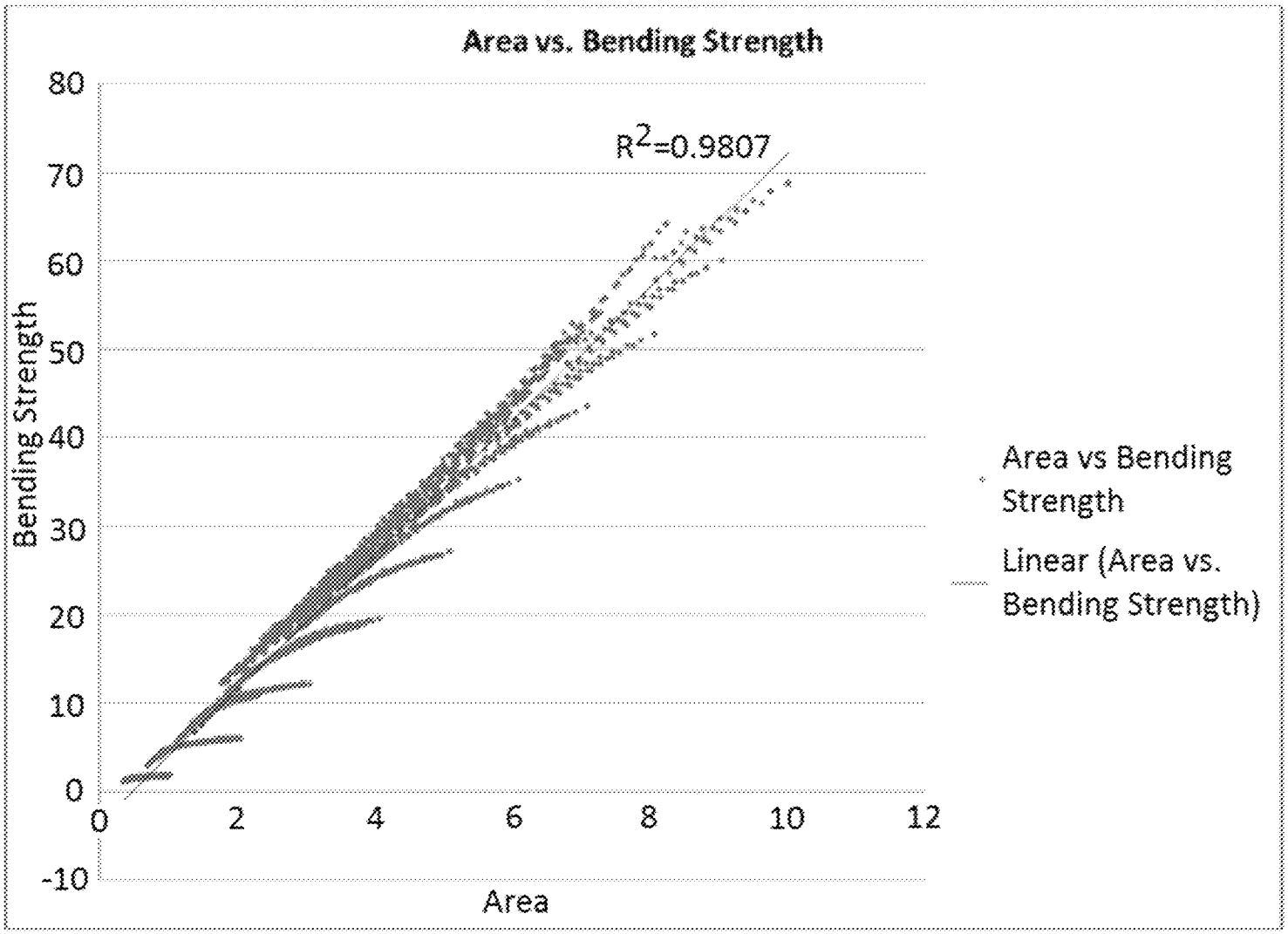
FIG. 3 shows a chart of area versus bending strength generated using a software program based upon various joist variables and variable ranges, according to an exemplary embodiment of the present disclosure.
Figure 4:
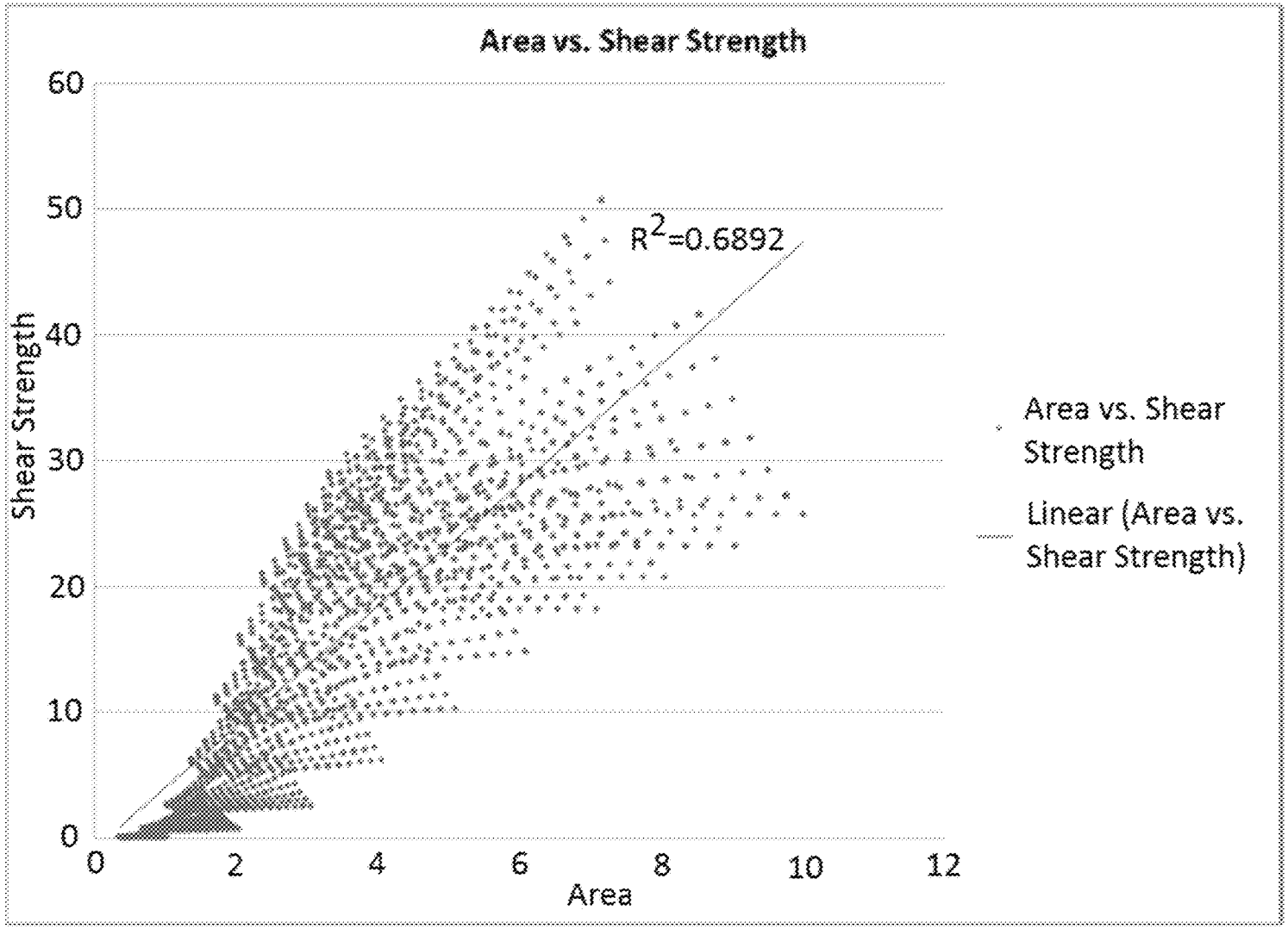
FIG. 4 shows a chart of area versus shear strength generated using a software program based upon various joist variables and variable ranges, according to an exemplary embodiment of the present disclosure.

Software program 300 then generated approximately 1700 different joist 100 configurations using the aforementioned parameters. FIG. 3 shows a plot of points of area versus bending strength, with a linear representation having an $R^2$ of 0.9807. Those approximately 1700 different joist configurations are also shown in FIG. 4, which shows a plot of points of area versus shear strength, with a linear representation having an $R^2$ of 0.6892. The best overall joist 100 configuration, out of the approximately 1700 different joist 100 configurations, was 10" deep (fixed, as noted above), having lengths L of side 103*c* of first leg portion 102 and distal side 105*c* of second leg portion 104 of 4.75", angles $a_1$, $a_2$, $a_3$, and $a_4$ of 45°, and the largest thickness in the study (t=0.2"). The worst overall joist 100 configuration was 10" deep (fixed), having the largest leg length (L=5.0"), angles $a_1$, $a_2$, $a_3$, and $a_4$ of 15°, and the smallest thickness in the study (t=0.02").

Figure 5:
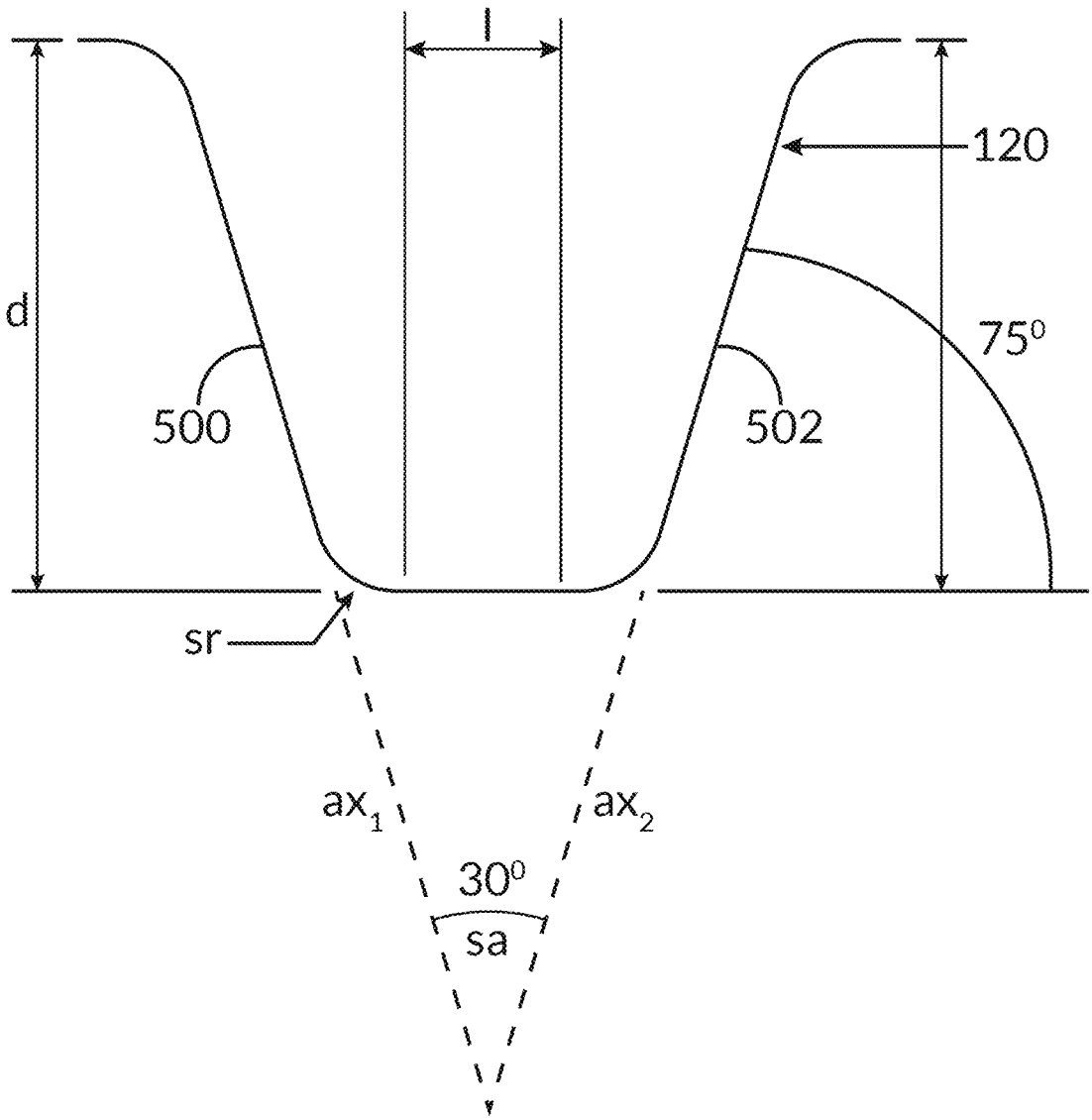
FIG. 5 shows a cross-section of a stiffener of a joist, according to an exemplary embodiment of the present disclosure.

Using an exemplary embodiment of said software program 300, various charts of data points were generated in attempt to identify an optimal joist 100 configuration for a particular purpose, with stiffeners. In a first test, the following parameters were used:

A stiffener 120 depth (d), as shown in FIG. 5, ranging from 1" to 5" using 0.25" increments Various stiffener 120 widths (l), as shown in FIG. 5

One, two, or three stiffeners 120 along first side 103*a*, second side 103*b*, distal side 103*c*, first side 105*a*, second side 105*b*, and distal side 105*c*

A constant length (L) of distal side 103*c* of first leg portion 102 and distal side 105*c* of second leg portion 104 of 6"

A constant thickness (t) of metal plate 150 of 0.08"

A stiffener 120 angle (sa) of 30° (noting that said stiffener 120 angle (sa) is measured between axes $ax_1$ and $ax_2$ defined by stiffener legs 500, 502, shown in FIG. 5)

A joist 100 depth (D) of 14"

A vertex radius of ⅛"

A first lap portion 170 and a second lap portion 172 each of 1"

Figure 6:
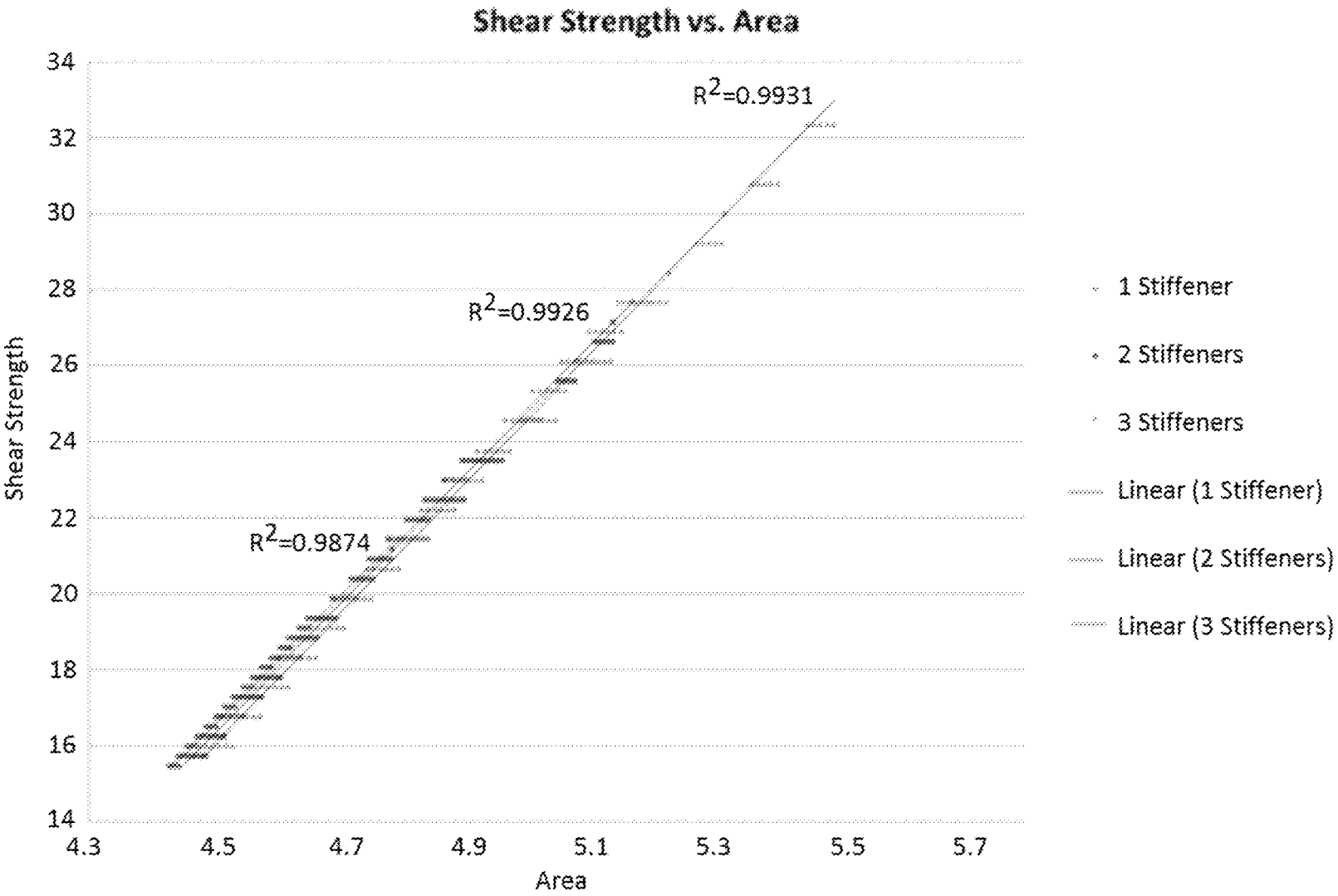
FIG. 6 shows a chart of shear strength versus area generated using a software program based upon various joist variables and variable ranges, according to an exemplary embodiment of the present disclosure.
Figure 7:
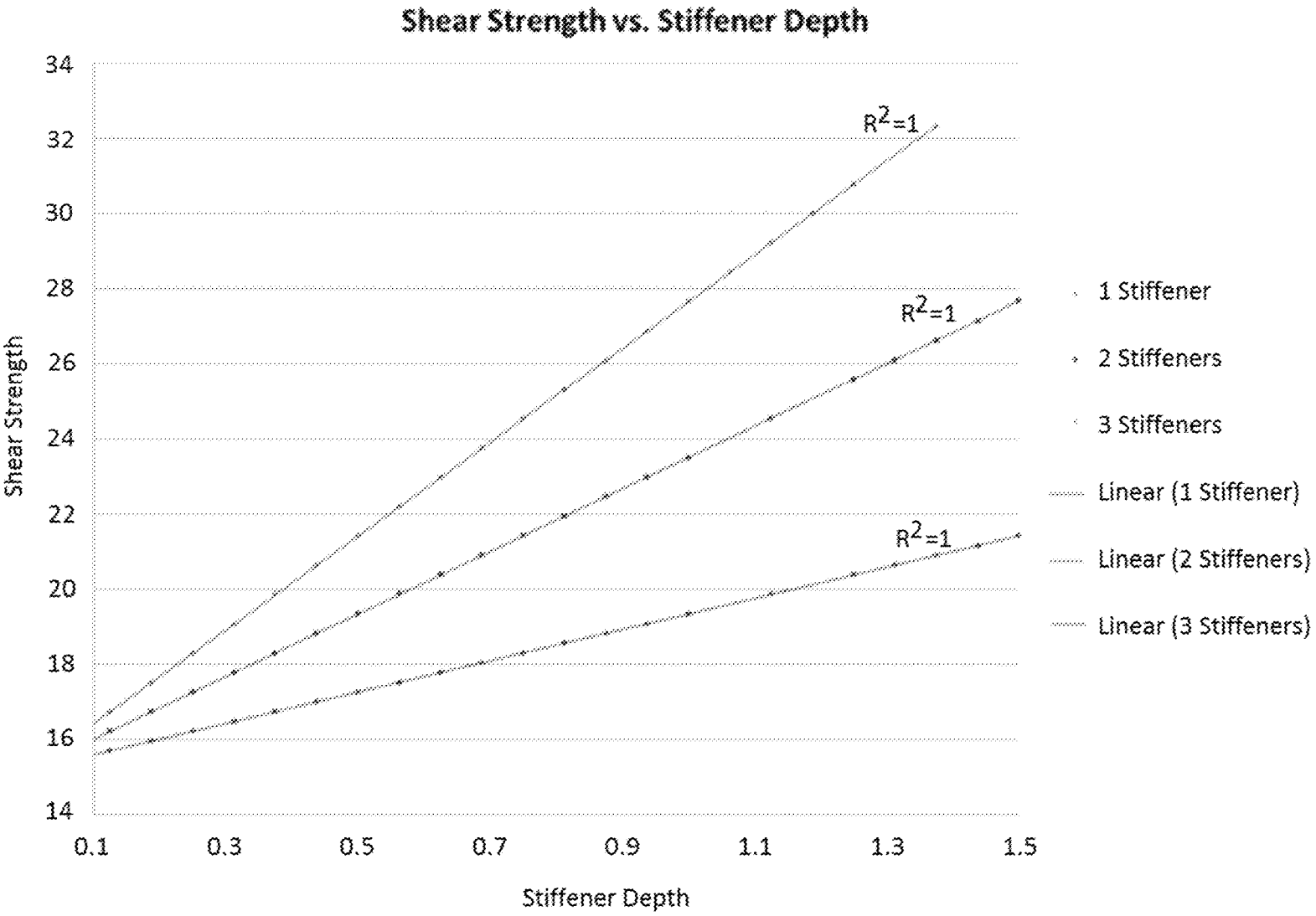
FIG. 7 shows a chart of shear strength versus stiffener depth generated using a software program based upon various joist variables and variable ranges, according to an exemplary embodiment of the present disclosure.
Figure 8:
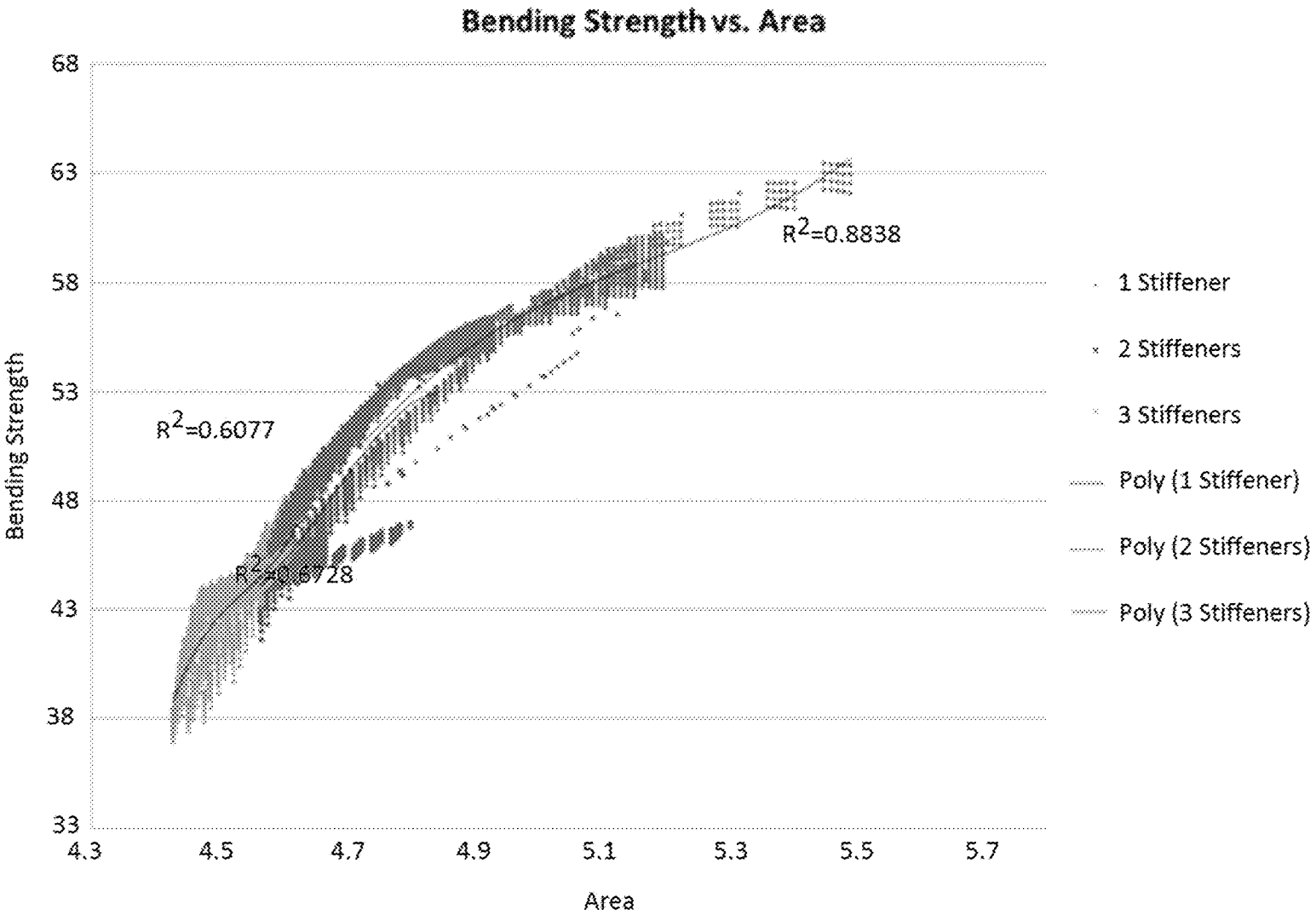
FIG. 8 shows a chart of bending strength versus area generated using a software program based upon various joist variables and variable ranges, according to an exemplary embodiment of the present disclosure.

Software program 300 then generated approximately 600 additional joist 100 configurations, resulting in approximately 2300 total different joist 100 configurations, using the aforementioned parameters. FIG. 6 shows a plot of points of shear strength vs area, for one, two, and three stiffeners 120, resulting in three different linear representations having an $R^2$ of 0.9874 (for joist 100 configurations having one stiffener 120 on each side 103*a*, 103*b*, 103*c*, 105*a*, 105*b*, and 105*c*), an $R^2$ of 0.9926 (for joist 100 configurations 100 having two stiffeners 120 on each side 103*a*, 103*b*, 103*c*, 105*a*, 105*b*, and 105*c*), and an $R^2$ Of 0.9931 (for joist 100 configurations having three stiffeners 120 on each side 103*a*, 103*b*, 103*c*, 105*a*, 105*b*, and 105*c*). Those approximately 2300 different joist configurations are also shown in FIG. 7, which shows a plot of points of shear strength versus stiffener depth, having a perfect linear correlation for each number of stiffeners 120. FIG. 8 shows the same configurations in a plot of bending strength versus area, where the plot generally tapers off for each number of stiffeners 120 (with the lower-right corner showing three stiffeners 120, and extending toward the upper left with two stiffener 120 embodiments and finally one stiffener 120 embodiments). The data revealed the strongest correlation between the number of stiffeners 120 and the depth of the stiffeners 120.

Figure 10:
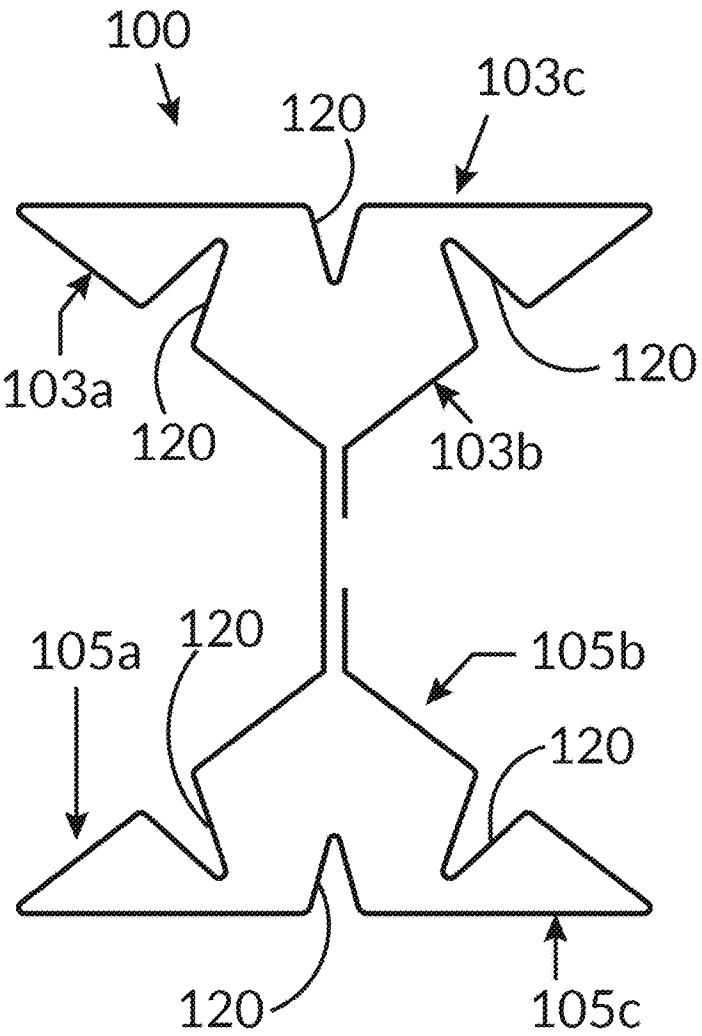
FIGS. 9, 10, 11, and 12 show cross-sections of joists having various stiffener numbers, sizes, and depths, according to exemplary embodiments of the present disclosure.
Figure 9:
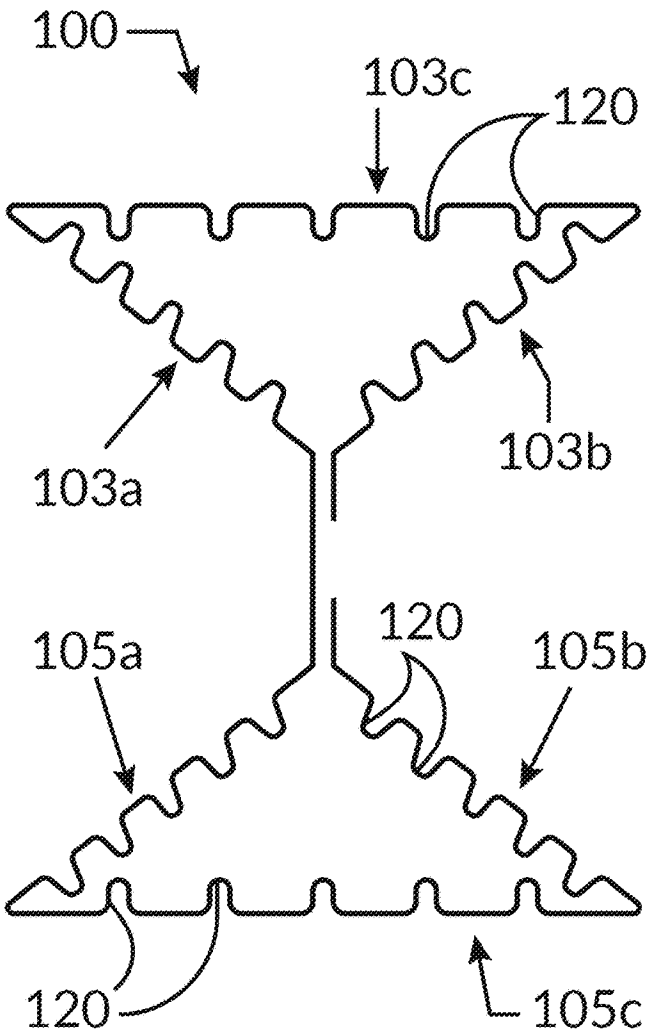
Figure 11:
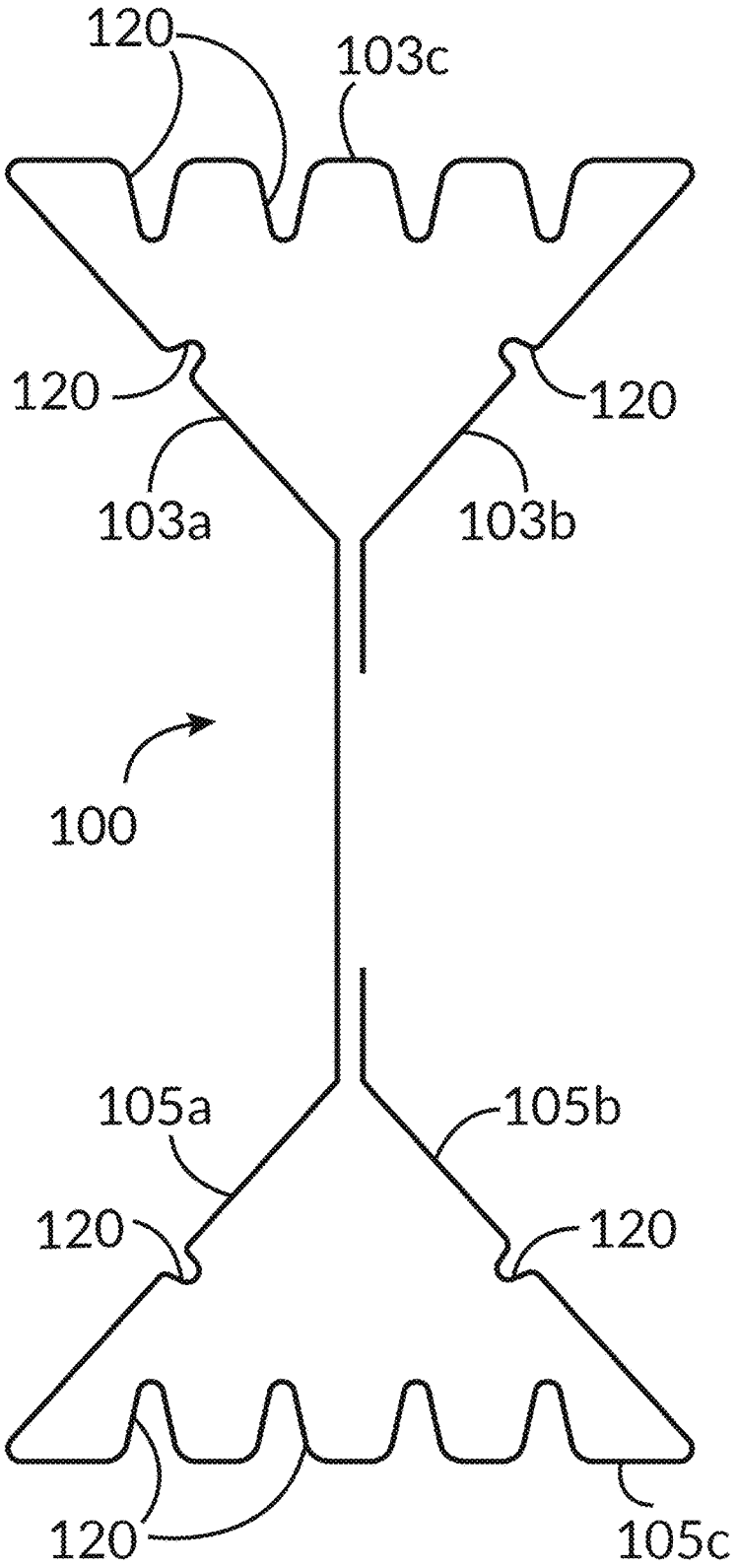

Additional studies were performed to test more stiffeners 120 (namely five stiffeners 120 on each side 103*a*, 103*b*, 103*c*, 105*a*, 105*b*, and 105*c*), adding approximately 6,000 more test designs for a total of approximately 8,500 test designs. Various joist 100 configurations were within the scope of those studies and within the scope of device embodiments of the present disclosure, such as joists 100 having zero, one, two, three, four, five, or more stiffeners 120 on one more of sides 103*a*, 103*b*, 103*c*, 105*a*, 105*b*, and 105*c*. Additional exemplary joist 100 embodiments are shown in cross-section in FIGS. 9, 10, and 11. FIG. 9 shows a joist 100 having five stiffeners 120 on each of sides 103*a*, 103*b*, 103*c*, 105*a*, 105*b*, and 105*c*, and joist 100 shown in FIG. 10 has one stiffener 120 on each of sides 103*a*, 103*b*, 103*c*, 105*a*, 105*b*, and 105*c*, as exemplary joist 100 embodiments. In at least another embodiment, such as shown in FIG. 10, joist 100 has four stiffeners 120 on sides 103*c* and 105*c*, and one stiffener 120 on each of sides 103*a*, 103*b*, 105*a*, and 105*b*. However, with joist 100 embodiments with several stiffeners 120 and/or large stiffeners 120 on sides 103*c* and/or 105*c*, the ability to connect a deck 200 (discussed in further detail herein) may be compromised due to a decreased amount of contact surface area between side(s) 103*c*, 105*c* and deck 200.

Figure 12:
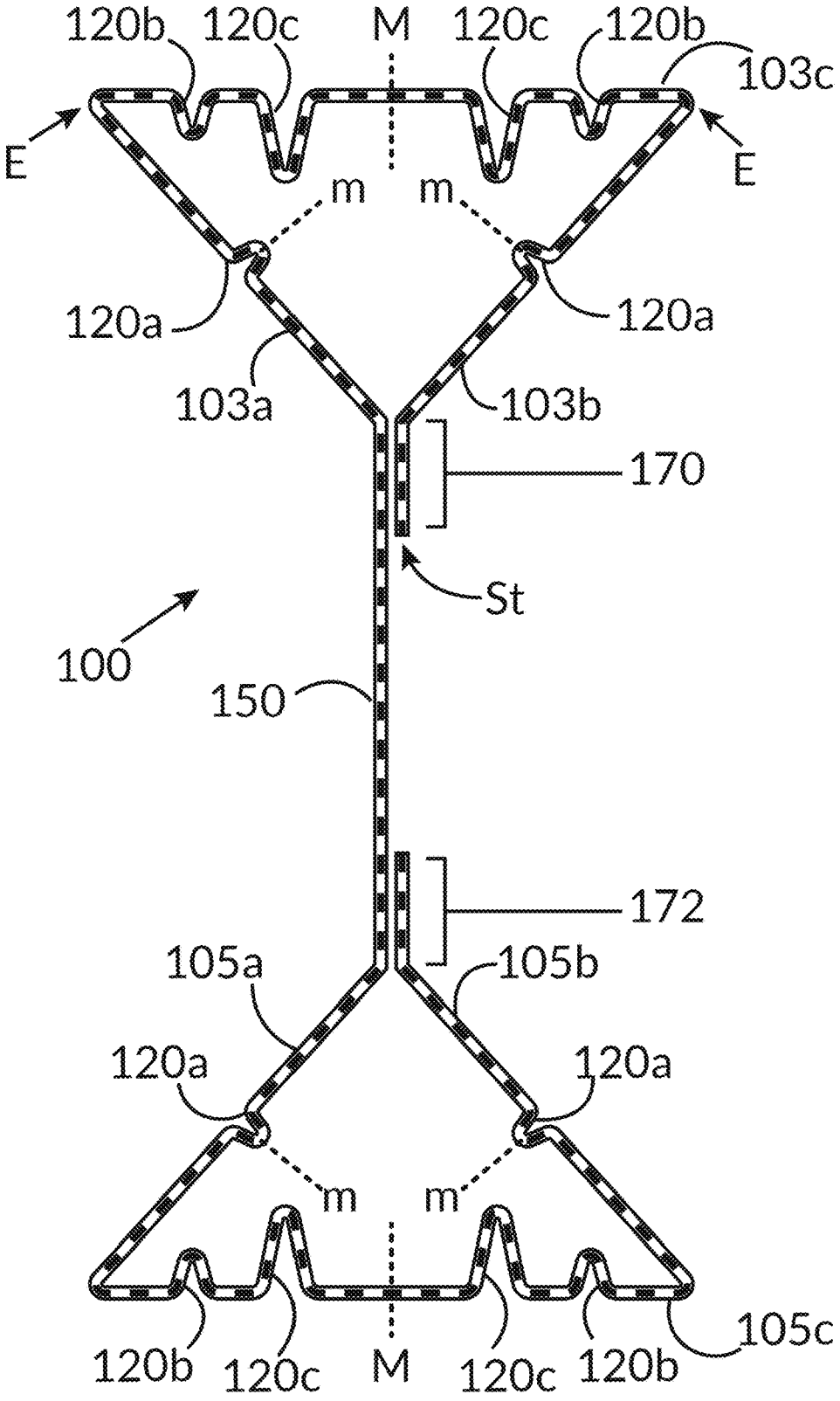

FIG. 12 shows another exemplary embodiment of a joist 100 of the present disclosure. As shown therein joist 100 has one stiffener 120*a* defined within each of sides 103*a*, 103*b*, 105*a*, and 105*b*. Stiffeners 120*a*, as shown in at least this exemplary embodiment, have the smallest depths (d). Stiffeners 120*a* may also be positioned at a relative midpoint (m) of sides 103*a*, 103*b*, 105*a*, and 105*b*, as shown in FIG. 12, and/or at other locations along said sides. Sides 103*c* and 105*c*, in an exemplary embodiment, each define two stiffeners 120*b* and two stiffeners 120*c*, with stiffeners 120*b* positioned closer to ends (E) than stiffeners 120*c*, such that stiffeners 120*c* are both positioned in between the two stiffeners 120*b* on each of sides 103*c* and 105*c*. Stiffeners 120*c*, as shown in FIG. 12, would then be defined within sides 103*c* and 105*c* closer to a midpoint (M) of sides 103*c* and 105*c* than stiffeners 120*b*. Furthermore, and in at least one embodiment, stiffeners 102*b* have a depth (d) larger than that of stiffeners 120*a*, and stiffeners 120*c* have a depth (d) larger than that of stiffeners 120*b*, such that stiffeners 120*a* have the smallest depth (d) and stiffeners 120*c* have the largest depth (d) in that embodiment, whereby the depth (d) of stiffeners 120*b* is larger than the depth (d) of stiffeners 120*a* but smaller than the depth (d) of stiffeners 120*c*. Various other joist 100 embodiments may have stiffeners 120*a*, 120*b*, and 120*c* in more or fewer numbers, such as zero, one, two, three, four, five, or more stiffeners 120*a*, 120*b*, and 120*c*, each having depths (d) that differ from one another (such that the depths of stiffeners 120*a* are consistent, the depths (d) of stiffeners 120*b* are consistent, and that the depths (d) of stiffeners 120*c* are consistent. In other embodiments, the number and sizes (including, but not limited to, relative depths (d)) of the various stiffeners 120 (such as stiffeners 120*a*, 120*b*, 120*c*, and others), may vary along the various sides 103*a*, 103*b*, 103*c*, 105*a*, 105*b*, and/or 105*c*.

Additional studies were performed to vary the following:

joist depths (d) at and between 10" and 16", using 2" steps, metal plate 150 thicknesses (t) at and between 0.033" and 0.065", using 0.001" steps, angles (a) at and between 48° and 50°, using 0.5° steps, and leg lengths (L) (of sides 103*c* and 105*c*) at and between 4.12"-4.22", using 0.02" steps resulting in another 2,500 tested joists 100.

Figure 13:
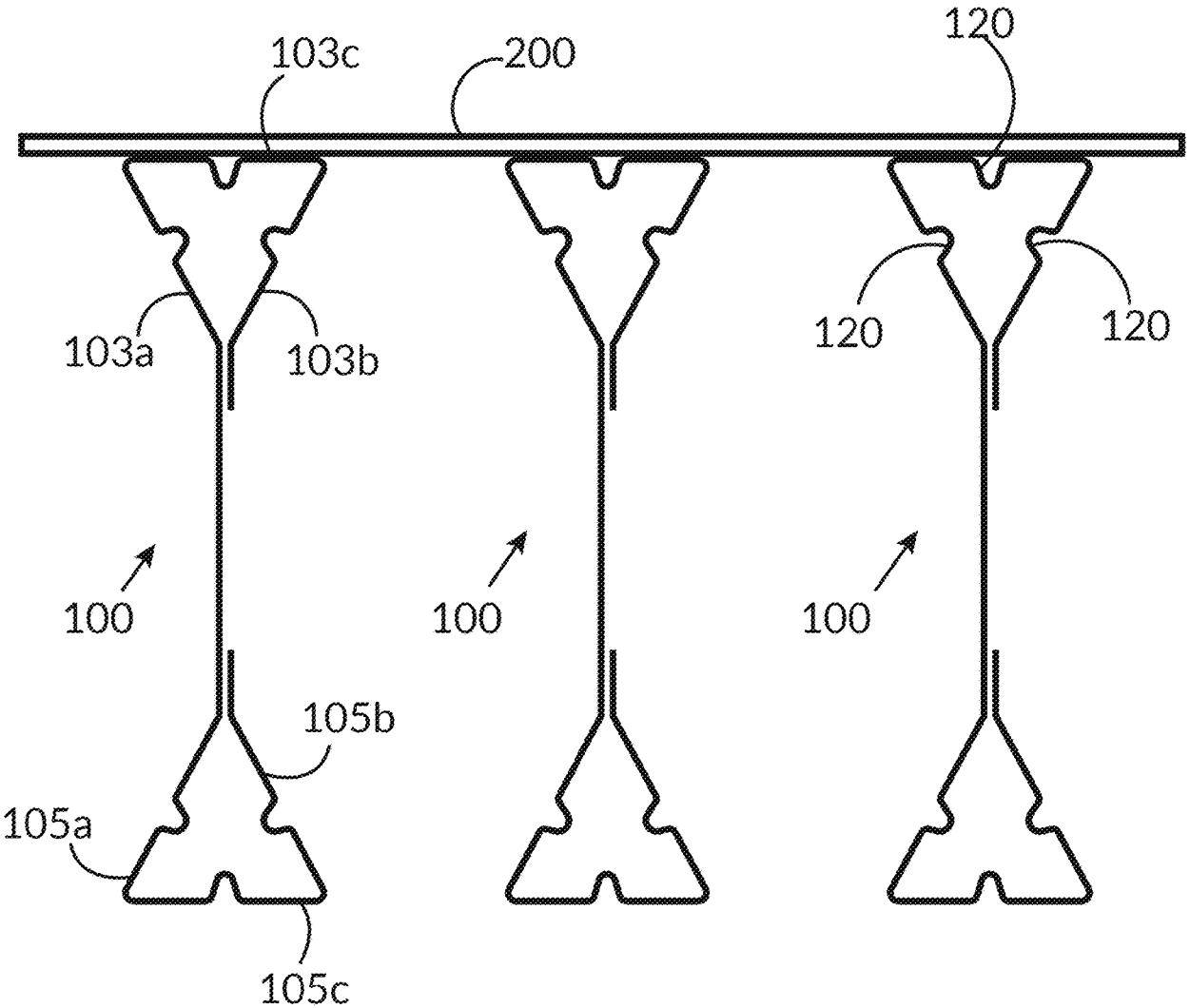
FIG. 13 shows joists supporting a deck, according to an exemplary embodiment of the present disclosure.

In view of the foregoing, exemplary joist 100 embodiments of the present disclosure can have some or all of the following characteristics:

lengths (L) of sides 103*c* and 105*c* at or between 1" to 12" or more or less, including, but not limited to, ranges of at or between 1" and 5", at or between 4" and 5", and the like, including individual lengths and/or ranges within the foregoing depths (D) at or between 3" to 24" or more or less, including, but not limited to, depths at or near 10", depths at or near 14", depths at or between 10" to 16", and the like, including individual depths and/or ranges within the foregoing thicknesses (t) at or between from 0.02" to 0.3" or more or less, including, but not limited to, ranges of at or between 0.03 and 0.07", and the like, including individual thicknesses and/or ranges within the foregoing angles ($a_1$, $a_2$, $a_3$, and/or $a_4$) at or between 15° and 60°, including angles at or between 30° and 60°, at or between 40° and 50°, at or near 45°, at or near 50°, and the like, including individual angles and/or ranges within the foregoing stiffener 120 depths (d) at or between 0.2" and 5", including individual depths and/or ranges within the foregoing FIG. 13 shows exemplary joists 100 of the present disclosure positioned such that one or more decks 200 are positioned on top of sides 103*c* (or sides 105*c*, not shown). Decks 200, as referenced herein, are materials positioned upon joists 100 to provide and/or support a surface. For example, a plurality of joists 100 could be used as bridge supports, while decks 200, positioned atop joists 100, provide the surface of the bridge.

As referenced herein, first leg portion 102 comprises three sides, namely sides 103*a*, 103*b*, and 103*c*, while second leg portion 104 comprises three sides, namely sides 105*a*, 105*b*, and 105*c*. Each of first leg portion 102 and second leg portion 104 have a generally triangular shape, but for the use of stiffeners 120 therein.

Stiffeners 120, such as those positioned along (or defined within) sides 103*a*, 103*b*, 105*a*, and 105*b*, provide additional structural support above and beyond the support that would be provided without said stiffeners 120. Prior to the present disclosure, it was unknown to form a joist having triangular first leg portions 102 and second leg portions 104, whereby sides 103*a*, 103*b*, 105*a*, and 105*b* have at least one stiffener 120 positioned along or defined therein.

Figure 15:
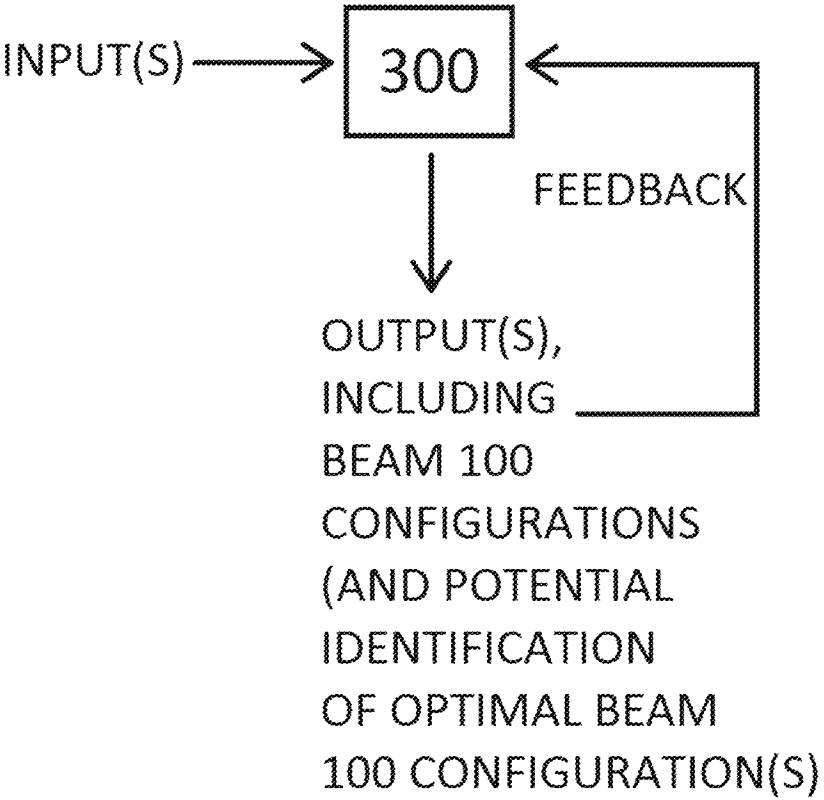
FIG. 15 shows a flow chart of how a computer uses various inputs to generate outputs, according to an exemplary embodiment of the present disclosure.
Figure 14:
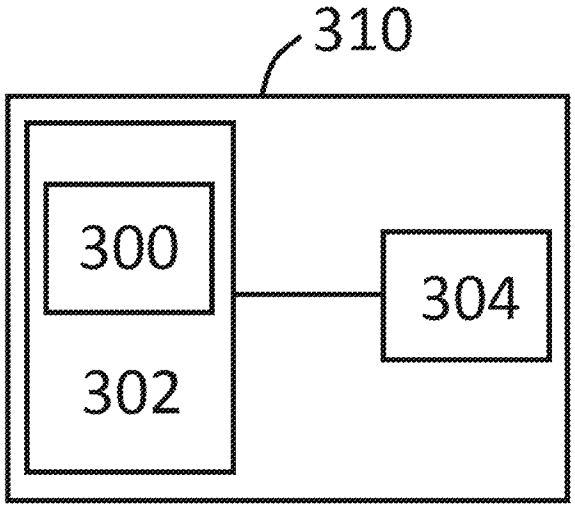
FIG. 14 shows a block component diagram of a computer having a processor operably connected to a storage medium having the software program stored thereon, according to an exemplary embodiment of the present disclosure.

Software program 300, as referenced herein, contains instructions that can be stored on a storage medium 302 and performed using a processor 304 operably connected to said storage medium 302, whereby performance of software program, in view of the various inputs (variables), can generate various outputs, such as the data included within FIGS. 3, 4, 6, 7, and 8. By varying the inputs (variables), software program 300 can provide output data relating to comparative strengths, stress testing, bending strength, shear strengths, etc., regarding various joist 100 configurations, so to provide information whereby an optimal joist 100 configuration can be selected for a particular purpose. Software program 300, in at least one embodiment, can generate output data (such as a first joist 100 configuration), whereby the output data causes the processor 304 to operate in a way to select one or more different variables to result in additional joist 100 configurations), whereby software program 300 ultimately causes processor 304 to operate to cause instructions within software program 300 to generate an optimal joist 100 configuration for a particular purpose as an output of performance of said software program 300. These elements are depicted in block format in FIG. 14, for example, with storage medium 302 and processor 304 collectively being referred to herein as a computer 310. The flow of information, such as introducing several inputs (variables and/or variable ranges, as referenced herein, such as length (L), depth (D), number of stiffeners 120, etc.), can be entered into software program 300 (operated using processor 304 of computer 310), whereby software program 300 can generate the output joist 100 configurations, and whereby at least one of the output joist 100 configurations can be considered by software program 300, which would change at least one variable to generate an additional output joist 100 configuration, until one or more optimal joist 100 configurations are identified, such as shown in the flowchart shown in FIG. 15.

Joists 100 of the present disclosure may be formed by strategically bending a single sheet of metal (such as elongated metal plate 150) in various directions, such as inward and outward, to generate joist 100. For example, and starting at starting point St as shown in FIG. 12, a single sheet of metal (elongated metal plate 150) could be bent outward (to the right in this example), inward (to start formation of stiffener 120), outward, inward (leaving strengthener 120), and inward again (to get to end E between side 103*b* and 103*c*), inward, outward, inward, inward, outward, inward, inward, outward, inward, inward, outward, inward, and inward again (to get to end E between side 103*c* and side 103*a*), and the like. The present disclosure therefore includes disclosure of introducing several bends into an elongated metal plate 150 to generate joist 100 configurations of the present disclosure. Phrased differently, the present disclosure includes disclosure of joists 100, having a plurality of stiffeners defined therein, generated by introducing multiple bends into a single elongated metal plate 150.

Figure 16:
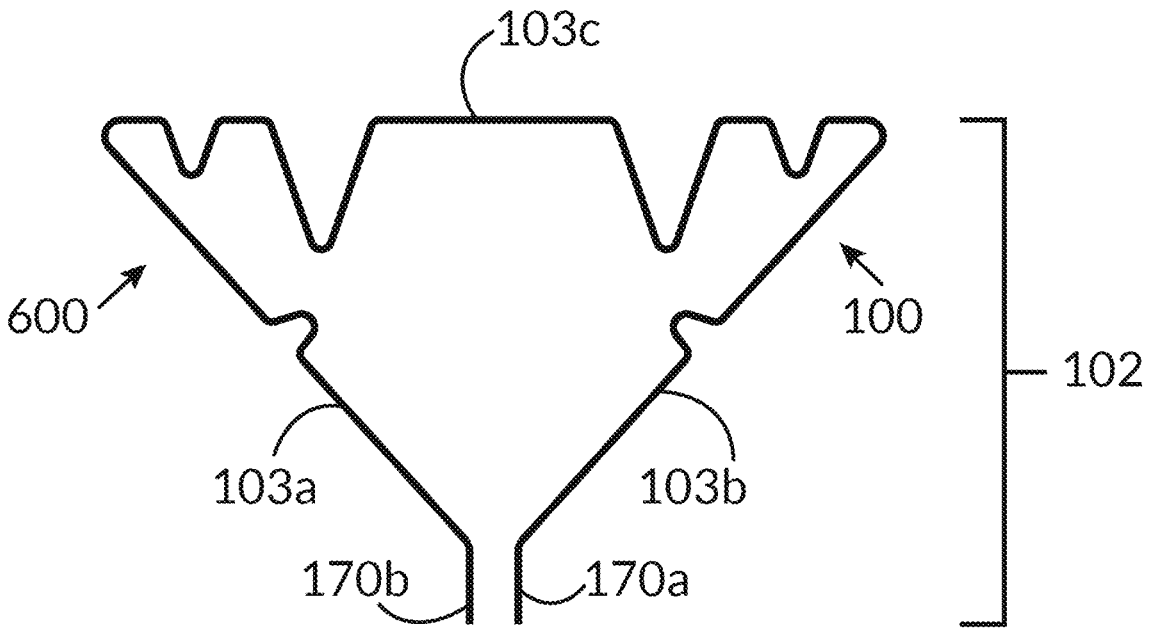
FIG. 16 shows a cross-sectional view of a first joist portion, according to an exemplary embodiment of the present disclosure.
Figure 17:
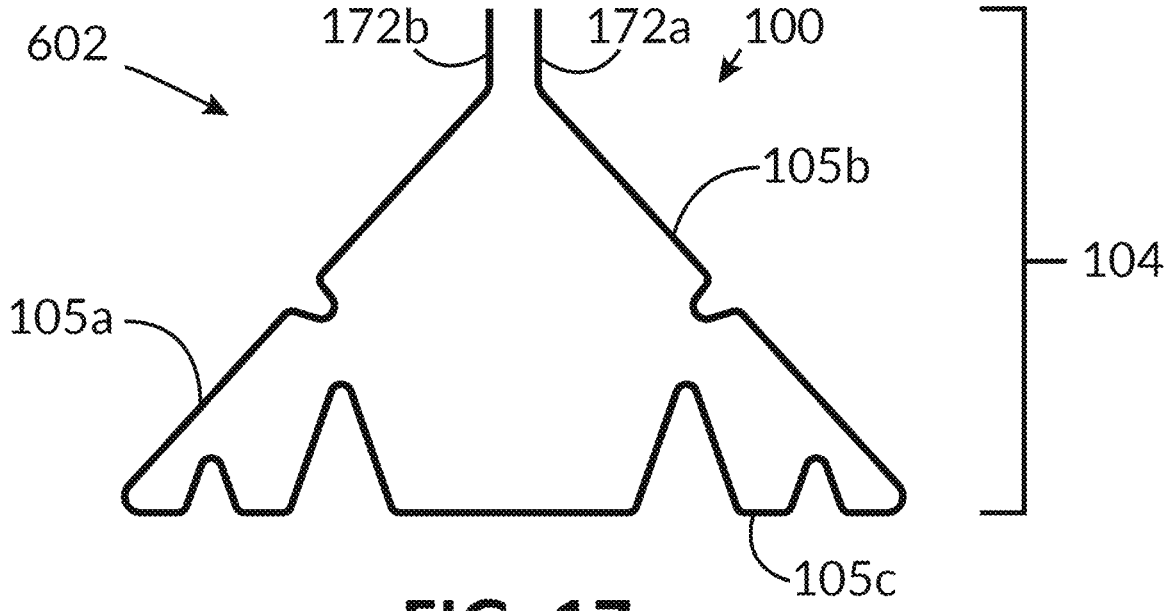
FIG. 17 shows a cross-sectional view of a second joist portion, according to an exemplary embodiment of the present disclosure.

Various joist 100 embodiments of the present disclosure can comprise separate portions, such as shown in FIG. 16, whereby certain portions could be generated by bending separate elongated metal plates 150. For example, as shown in FIG. 16, a portion of an exemplary joist 100 of the present disclosure is shown, whereby first side 103*a*, second side 103*b*, distal side 103*c*, and lap portions 170*a*, 170*b* are defined by bending a single elongated metal plate 150, such as to form an exemplary first joist component 600 of a joist 100 (similar to a first leg portion 102 of a joist 100). Similarly, FIG. 17 shows another portion of an exemplary joist 100 of the present disclosure, whereby first side 105*a*, second side 105*b*, distal side 105*c*, and lap portions 172*a*, 172*b* are defined by bending a single elongated metal plate 150, such as to form an exemplary second joist component 602 of a joist 100 (similar to a second leg portion 104 of a joist 100).

Figure 18B:
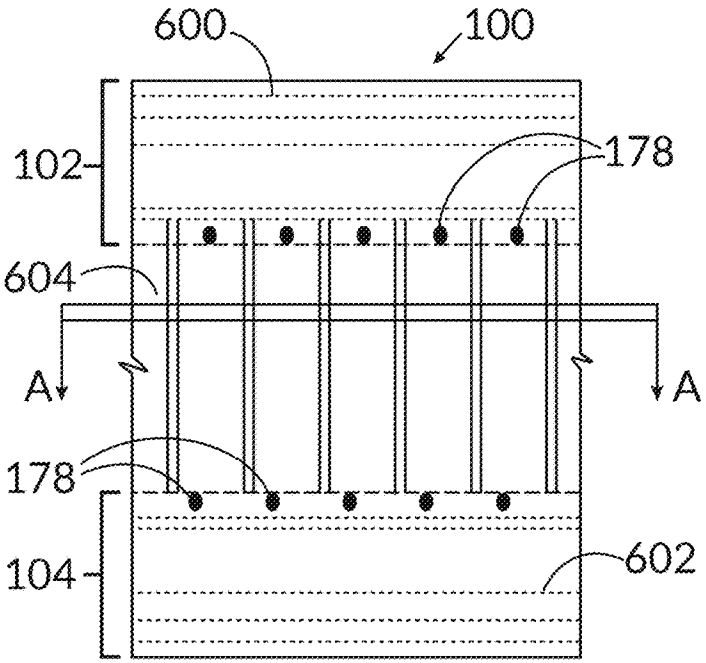
FIG. 18B shows a side view of a joist comprising a first joist portion, a second joist portion, and a central joist portion, according to an exemplary embodiment of the present disclosure.
Figure 18A:
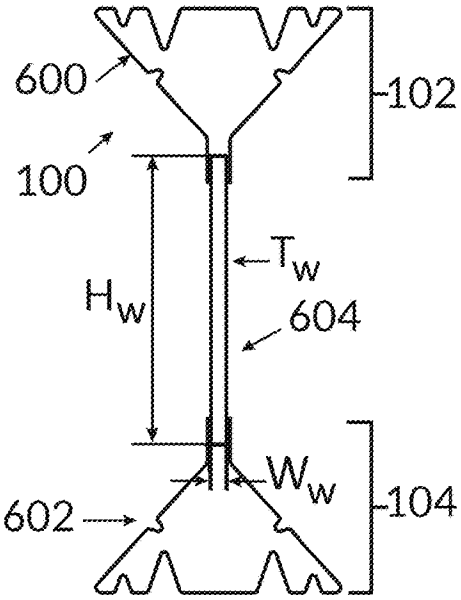
FIG. 18A shows a cross-sectional view of a joist comprising a first joist portion, a second joist portion, and a central joist portion, according to an exemplary embodiment of the present disclosure.

FIG. 18A shows a cross-sectional view of an exemplary joist 100 of the present disclosure, comprising a first joist component 600, a second joist component 602, and a central joist component 604. First joist component 600 and second joist component 602 can be attached to central joist component 604 using welds 178 (as shown in FIG. 18B and also as shown in FIG. 2, in any number or location), rivets 180 (as shown in FIG. 1), fasteners 182 (such as bolts, nuts, screws, nails, and/or other fasteners, as shown in FIG. 1), etc., as may be desired. In at least one embodiment, and as shown in FIG. 18A, first joist component 600 and second joist component 602 are coupled to central joist component 604 using welds 178. FIG. 18B shows a side view of the exemplary joist 100 shown in FIG. 18A.

Central joist component 604 can comprise any number of widths, lengths, heights, configurations, etc., as may be desired/suitable for a particular application. For example, central joist portions 604 can have a height ($H_w$), an overall width ($W_w$), and an overall material thickness ($T_w$), such as shown in FIG. 18A (with width ($W_w$) and thickness ($T_w$) also shown in FIG. 18C).

Figure 18C:
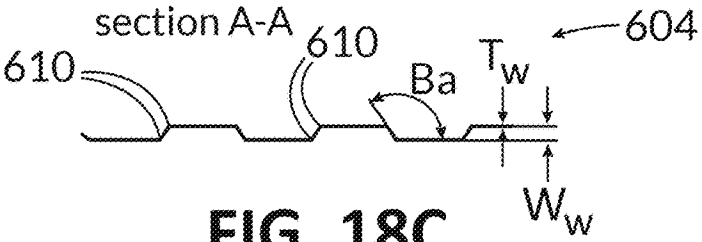
FIG. 18C shows a cross-sectional view of a central joist portion, according to an exemplary embodiment of the present disclosure.

In at least one embodiment, central joist component 604 comprises an elongated metal plate 150, such as used to create first joist portions 600, second joist portions 602, and/or other joist 100 embodiments, comprising bends or no bends. FIG. 18C shows section A-A from FIG. 18B, whereby various bends 610 are formed within elongated metal plate 150 of central joist component 604, in at least one embodiment. Bends 610 can be formed as defined using various angles $B_a$, such as shown in FIG. 18C.

FIG. 19 shows a side view of an exemplary joist 100 of the present disclosure. As shown therein, joist 100, in various examples, can have an end angle (Ea) of or about 45° (as shown in FIG. 19), 90° (a right angle), or any suitable angle less than or greater than 90°. Furthermore, various bearing plates 1900 can be coupled to joist 100, such as by way of welds 178, rivets 180, fasteners 182, etc., such that bearing plates 1900 may be used to provide additional support at relative ends of joist 100 or at other locations of joist 100 and/or to facilitate a transition between joist 100 and a surface adjacent to where joist 100 is ultimately positioned.

As referenced herein, joists 100, or portions thereof, can be made via bending one or more elongated metal plates 150. One metal plate 150 may be used, such as shown in FIGS. 1 and 2, three metal plates 150 may be used (to generate first joist component 600, second joist component 602, and central joist component 604, as shown in FIG. 18A), or fewer or more metal plates 150 may be used. In at least one embodiment of the present disclosure, joist 100 is generated by bending two metal plates 150 to form first joist component 600 and second joist component 602, whereby first joist component 600 and second joist component 602 are coupled to a central joist component 604, which itself may be generated by bending a third metal plate 150 to form central joist component 604. Said bending of metal plates 150 can be done at ambient temperature, elevated temperature, or lowered temperature, and in instances where said bending of metal plates 150 occurs without an increase in temperature, said metal plate 150 may be referenced as being "cold-formed" to generate the desired joist 100 configuration or component thereof. As such, the present disclosure includes disclosure of cold-formed joists 100 and components thereof, useful as substitutes for traditional steel joists known in the art.

Figure 20:
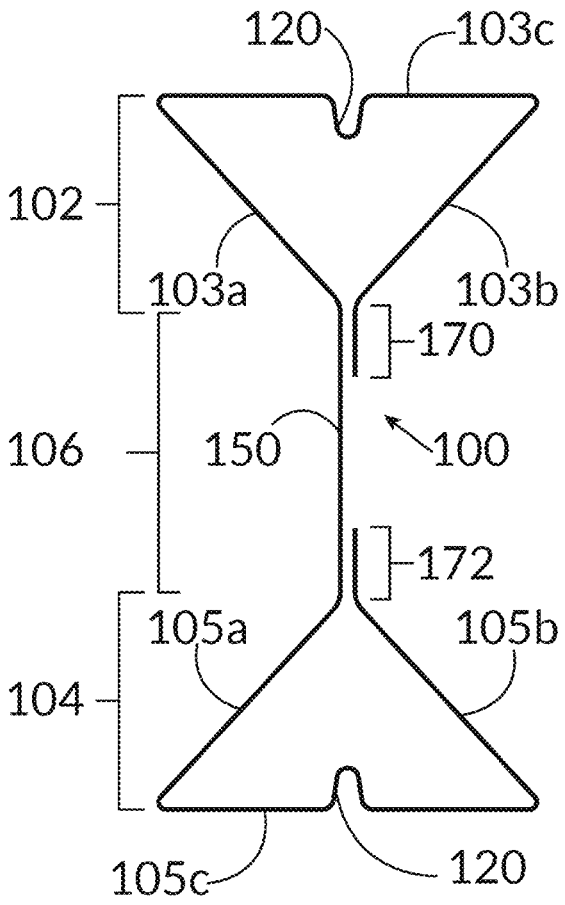
FIGS. 20 and 21 show cross-sectional views of joists, according to exemplary embodiments of the present disclosure.
Figure 21:
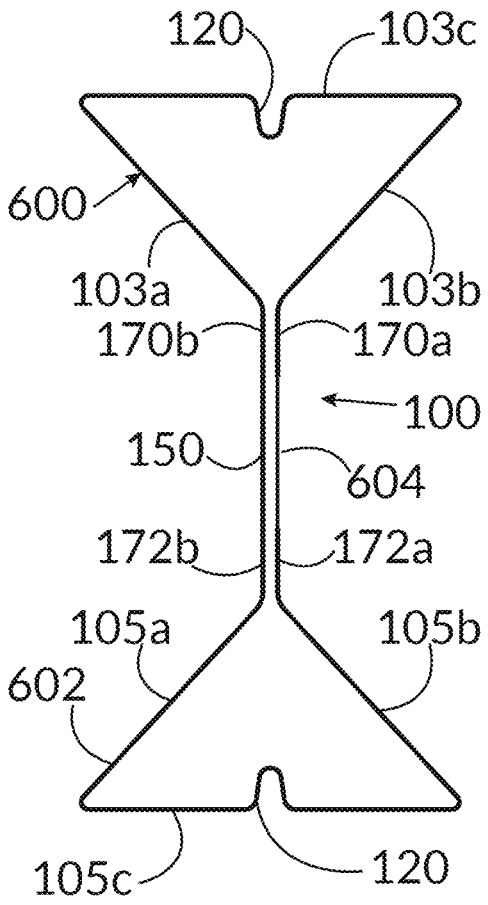

FIGS. 20 and 21 show additional exemplary embodiments of joists 100 of the present disclosure. As shown therein, joists 100 comprise only one stiffener 120 on each relative end of joist, such as at/within sides 103*c* and 105*c*. As such, exemplary joists 100 of the present disclosure can comprise a first leg portion 102, a second leg portion 104, and a central portion 106, wherein each of the first leg portion 102 and the second leg portion 104 define a first side (103*a* and 105*a*), a second side (103*b* and 105*b*), and a distal side (103*c* and 105*c*), and wherein at least one stiffener 120 is defined within at least one of sides 103*a*, 103*b*, and/or 103*c* and/or at least one of sides 105*a*, 105*b*, and/or 105*c*, such as shown in FIG. 20. Other exemplary joists 100 of the present disclosure, such as shown in FIG. 21, can comprise a first joist component 600, a second joist component 602, and a central joist component 604, wherein each of the first joist component and the second joist component define a first side (103*a* and 105*a*), a second side (103*b* and 105*b*), and a distal side (103*c* and 105*c*), and wherein at least one stiffener 120 is defined within at least one of sides 103*a*, 103*b*, and/or 103*c* and/or at least one of sides 105*a*, 105*b*, and/or 105*c*. In view of the foregoing, the present disclosure includes disclosure of joists 100 having one or more stiffeners 120 present thereon, such as one stiffener 120 present at side 103*c*, one stiffener 120 present at side 105*c*, one stiffener 120 present at side 103*c* and side 105*c*, and the like, Joists 100 of the present disclosure have the advantages of being less costly to produce than traditional steel joists, being stronger than similar weight traditional steel joists, and taking less manpower to produce.

While various embodiments of devices for structural joists and methods for manufacturing and using the same have been described in considerable detail herein, the embodiments are merely offered as non-limiting examples of the disclosure described herein. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A joist, comprising:

a first leg portion, a second leg portion, and a central portion, wherein each of the first leg portion and the second leg portion define a first side, a second side, and a distal side;

wherein each of the first sides and the second sides define a first stiffener therein;

wherein each of the distal sides define two second stiffeners and two third stiffeners therein;

wherein the two second stiffeners have a depth different than that of the two first stiffeners;

wherein the two third stiffeners have a depth different than that of the two second stiffeners; and wherein a longest flat portion of the distal sides of the first leg portion and the second leg portion is located at a relative middle of said distal sides.

2. The joist of claim 1, wherein the two second stiffeners have a depth larger than that of the two first stiffeners.

3. The joist of claim 1, wherein the two third stiffeners have a depth larger than that of the two second stiffeners.

4. The joist of claim 1, further comprising:

a first lap portion and a second lap portion located at the central portion.

5. The joist of claim 1, wherein portions of said joist are formed by bending an elongated metal plate.

6. The joist of claim 1, wherein each of the two second stiffeners are located between each of two third stiffeners and relative endpoints of each of the distal ends.

7. The joist of claim 1, wherein the joist is cold-formed.

8. The joist of claim 1, wherein the joist comprises two or more elongated metal plates.

9. A joist, comprising:

a leg portion located at each of two relative ends of a central portion;

wherein each of a first side and a second side of each leg portion has one, or two first stiffeners defined therein;

wherein a distal side of each leg portion has at least four stiffeners defined therein;

wherein the at least four stiffeners comprise two second stiffeners and two third stiffeners;

wherein the two second stiffeners have a depth different than that of the one or two first stiffeners;

wherein the two third stiffeners have a depth different than that of the two second stiffeners; and wherein a longest flat portion of the distal sides of the first leg portion and the second leg portion is located at a relative middle of said distal sides.

10. The joist of claim 9, wherein the two third stiffeners have a depth greater than a depth of the two second stiffeners.

11. The joist of claim 9, further comprising:

a first lap portion and a second lap portion located at the central portion.

12. A joist, comprising:

a first leg portion, a second leg portion, and a central portion, wherein each of the first leg portion and the second leg portion define a first side, a second side, and a distal side; and at least one first stiffener defined within each the first side and the second side of the first leg portion and/or the second leg portion; and at least four stiffeners defined within the distal side of the first leg portion and the second leg portion, the at least four stiffeners comprising two second stiffeners and two third stiffeners;

wherein the two second stiffeners have a depth different than that of the at least one stiffener;

wherein the two third stiffeners have a depth different than that of the two second stiffeners; and wherein a longest flat portion of the distal sides of the first leg portion and the second leg portion is located at a relative middle of said distal sides.

13. The joist of claim 12, wherein the two second stiffeners have a depth larger than the at least one first stiffener.

14. The joist of claim 12, wherein the at least one first stiffener comprises two first stiffeners.

15. The joist of claim 9, wherein the two second stiffeners have a depth different than that of the first stiffeners.

16. The joist of claim 9, wherein the two third stiffeners have a depth different than that of the two second stiffeners.

17. The joist of claim 12, wherein the two second stiffeners have a depth different than that of the first stiffeners.

18. The joist of claim 12, wherein the two third stiffeners have a depth different than that of the two second stiffeners.

19. The joist of claim 9, wherein each of the two second stiffeners are located between each of two third stiffeners and relative endpoints of each of the distal ends.

20. The joist of claim 9, wherein the joist comprises two or more elongated metal plates.

* * * * *